US012667936B2

(12) United States Patent
Schumacher et al.

(10) Patent No.: US 12,667,936 B2
(45) Date of Patent: Jun. 30, 2026

(54) BONDED ABRASIVE ARTICLES AND METHODS OF MANUFACTURE

(71) Applicant: 3M INNOVATIVE PROPERTIES COMPANY, St. Paul, MN (US)

(72) Inventors: Knut Schumacher, Neuss (DE); Jean-Luc Rifaut, Brussels (BE); Tilo Remhof, Hilden (DE); Benjamin J. Muenstermann, Duisburg (DE)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 652 days.

(21) Appl. No.: 17/904,823

(22) PCT Filed: Feb. 17, 2021

(86) PCT No.: PCT/IB2021/051339
§ 371 (c)(1),
(2) Date: Aug. 23, 2022

(87) PCT Pub. No.: WO2021/171141
PCT Pub. Date: Sep. 2, 2021

(65) Prior Publication Data

US 2023/0111065 A1 Apr. 13, 2023

Related U.S. Application Data

(60) Provisional application No. 62/981,056, filed on Feb. 25, 2020.

(51) Int. Cl.
*B24D 18/00* (2006.01)

(52) U.S. Cl.
CPC ..... *B24D 18/0072* (2013.01); *B24D 18/0009* (2013.01); *B24D 18/009* (2013.01)

(58) Field of Classification Search
CPC ..... B22B 1/001; B33Y 30/00; B33Y 10/00; B24D 18/0072
See application file for complete search history.

(56) References Cited

U.S. PATENT DOCUMENTS 4,652,275 A * 3/1987 Bloecher ..... C09K 3/1436 51/307
2016/0107381 A1 4/2016 Krishnan
(Continued)

FOREIGN PATENT DOCUMENTS

CN 105172144 B 9/2017
CN 104999385 B 5/2018
(Continued)

OTHER PUBLICATIONS

International Search Report for PCT International Application No. PCT/IB2021/051339, mailed on May 25, 2021, 4 pages.

*Primary Examiner* — Pegah Parvini
(74) *Attorney, Agent, or Firm* — Melissa E. Buss; Katherine M. Scholz

(57) ABSTRACT

A system for forming an abrasive article is presented. The system includes a workspace and an abrasive material dispenser that deposits a layer of abrasive material onto the workspace. The system also includes a leveler that levels a surface of abrasive material on the workspace. The system also includes a binder jet printer that dispenses a liquid binder onto the layer of abrasive material. The workspace is on a moving surface that moves the workspace between a dispensing position under the dispenser, a leveling position under the leveler, and a printing position, under the printer.

19 Claims, 7 Drawing Sheets

(56) References Cited

U.S. PATENT DOCUMENTS

| | | | | |
|---|---|---|---|---|
| 2018/0104793 | A1* | 4/2018 | Franke | B24D 5/02 |
| 2018/0263081 | A1 | 9/2018 | Dardona | |
| 2019/0201976 | A1* | 7/2019 | Ng | B22F 3/15 |
| 2020/0070311 | A1 | 3/2020 | Smithson et al. | |

FOREIGN PATENT DOCUMENTS

| | | | | |
|---|---|---|---|---|
| DE | 4233812 | C1 | 11/1993 | |
| DE | 102012020000 | A1 | 4/2014 | |
| JP | 2020501928 | A | 1/2020 | |
| KR | 20170072261 | A | 6/2017 | |
| WO | 1994007681 | A1 | 4/1994 | |
| WO | 2014056482 | A1 | 4/2014 | |
| WO | 2015167520 | A1 | 11/2015 | |
| WO | 2016048305 | A1 | 3/2016 | |
| WO | 2016060857 | A1 | 4/2016 | |
| WO | 2018118566 | A1 | 6/2018 | |
| WO | WO-2018136269 | A1 * | 7/2018 | B24D 18/00 |
| WO | 2019017929 | A1 | 1/2019 | |
| WO | 2020128779 | A2 | 6/2020 | |
| WO | 2021014271 | A1 | 1/2021 | |

* cited by examiner

BONDED ABRASIVE ARTICLES AND METHODS OF MANUFACTURE

CROSS REFERENCE TO RELATED APPLICATIONS

This application is a national stage filing under 35 U.S.C. 371 of PCT/IB2021/051339, filed Feb. 17, 2021, which claims the benefit of U.S. Provisional Application No. 62/981,056, filed Feb. 25, 2020, the disclosure of which is incorporated by reference in its/their entirety herein.

BACKGROUND

The present disclosure relates to 3D printing, more specifically to the 3D printing of bonded abrasive articles. Bonded abrasive wheels have been made using conventional methods such as pressure-based molding. Bonded abrasive articles can have a vitreous, polymer or metal-based bond and can include wheels of varying sizes for different abrasive applications.

BRIEF DESCRIPTION OF THE FIGURES

The drawings illustrate generally, by way of example, but not by way of limitation, various embodiments discussed in the present document.

DETAILED DESCRIPTION

Figure 1:
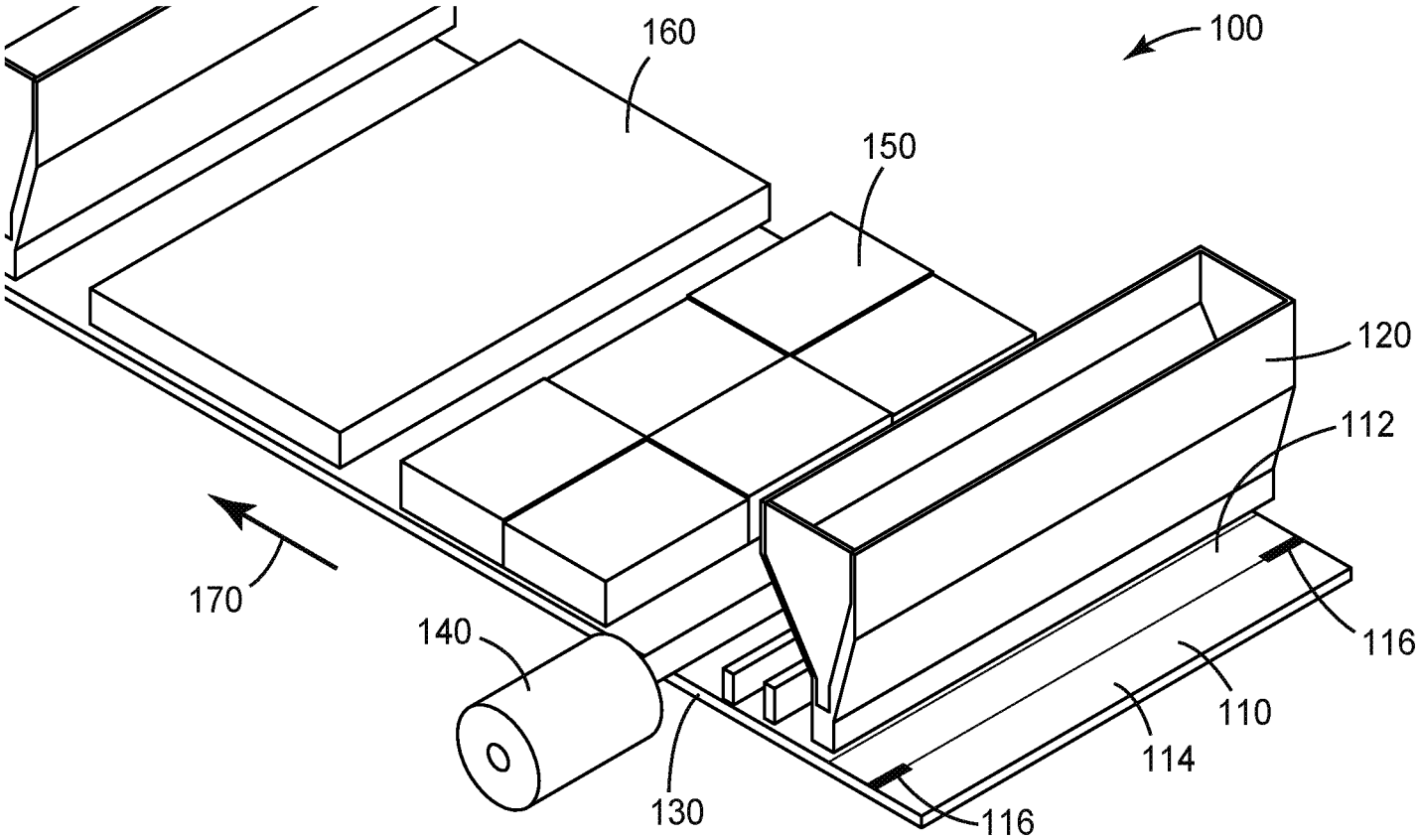
FIG. 1 illustrates a platform for continuous additive manufacturing of an abrasive product, in accordance with various embodiments.

Reference will now be made in detail to certain embodiments of the disclosed subject matter, examples of which are illustrated in part in the accompanying drawings. While the disclosed subject matter will be described in conjunction with the enumerated claims, it will be understood that the exemplified subject matter is not intended to limit the claims to the disclosed subject matter.

Additionally, while the description herein primarily concerns the production of abrasive articles by additive manufacturing, it is expressly contemplated that the methods and systems described herein may apply to the printing of other parts or articles that would benefit from modular treatment. For example, any article that can be made by depositing and partially curing in a layer by layer process would be suitable for systems and methods described herein.

Additive manufacturing processes for making abrasive articles have been described before and allow for the creation of parts that cannot be made using conventional methods. However, creating an abrasive article layer per layer presents a challenge because of the time needed to build each layer, reducing the range of potential products because the process cost. One way to address that time constrain is to use a continuous process, where some or all of the 3D printing steps are done together at the same time.

This can reduce the layer building time by more than half and increase the throughput of the printer.

The time needed for each different step is highly dependent of the powder or the mixture which is printed. A highly flowable powder can be spread and levelled much faster than a mixture having a poor flowability behavior. A highly conductive powder can be heated and dried faster than a refractory or ceramic material. Printing time is driven by the powder used but also by the precision needed on the final piece (driving the thickness layer) and by the needed strength to handle the printed part before the final consolidation step.

Additive manufacturing can also allow for printing different features on each printed grinding wheel. Such an embodiment combines the advantages of the digitalization of the traditional binder jet printer with the spiral continuous building process. For example, using a temporary binder, it is possible to print an abrasive article with complex internal structure, such as the shapes and structures discussed in co-owned provisional patent application Ser. No. 62/877,443, filed on Jul. 23, 2019, and U.S. Patent Application Publication 2018/0104793, filed on Jun. 23, 2016 which are incorporated by reference herein. For example, a bonded abrasive article can be constructed using binder jet methods described herein, to have arcuate, tortuous, or straight channels extending partway or completely throughout. Bonded abrasive articles can also be constructed with structures extending only partway through, and can include impeller structures that direct cooling fluids to the grinding area. Additionally, channels may extend from an interior to an exterior surface of the bonded abrasive article.

One potential continuous process, discussed in US PCT Patent Application Ser. No. IB2019/060840, filed on Dec. 16, 2019, involves using a spiral design to deposit layers of abrasive material, binder and allow the structure to set prior to repeating. However, as discussed in that application, there is a limited amount of space on a circular platform and, therefore, a limit to how many layers can be placed simultaneously. Additionally, the limiting factor of a given abrasive article, whether it be poor flowability, slow drying or curing time, or binder dispensing speed still controls the rotational speed at which the system can operate.

In the systems described below, a modular additive manufacturing system is presented that allows for more control over the limiting step of a given abrasive operation. FIGS. 1-5 describe a continuous printing system that prints abrasive article precursors. It is expressly understood that the term "abrasive article" as used with respect to a product generated by a continuous printer can refer to both an abrasive article precursor that may require additional firing, such as vitreous or metal bonded abrasive particles, as well as abrasive articles that are substantially finished products without additional firing requirements, such as resin bonded abrasive articles.

However, while manufacture of bonded abrasive articles are described as an example herein, it is expressly contemplated that systems and methods described herein can be used for manufacturing other types of abrasive products, such as coated abrasive articles. Additionally, systems and methods described herein may be useful for other multi-component structures formed through additive manufacturing that include a curing agent, hardening agent or setting step.

FIG. 1 illustrates a platform for continuous additive manufacturing of an abrasive product. Platform 100 may allow for faster continuous manufacture of abrasive products by allowing several steps in the process to be completed simultaneously. The basic steps for additive manufacturing of an abrasive product using a binder jet system include depositing an abrasive mixture using a hopper 120, leveling the layer using a leveler 130 and a compactor 140, printing a binder using a binder array 150, and setting the layer using a setting station 160.

In one embodiment, platform 100 has a rectangular shaped workspace 110. The shape of workspace 110 is sized to being able to print multiples abrasive articles in a specific size range. For example, the individual abrasive articles may have sizes ranging from about 2 mm diameter up to about 170 mm diameter after sintering are selected.

Platform 110 can move in space as indicated by arrow 170. In one embodiment, a conveyance mechanism moves workspace 110 as indicated by arrow 170. Workspace 100 may move sequentially under a series of components, each of which conducts an operation on the article being manufactured.

In one embodiment platform 100 is surrounded by walls that prevent abrasive mixture from spilling outside of the platform area. However, in another embodiment, walls are simultaneously printed as part of the abrasive article design. For example, an abrasive material dispenser 120 may include three segments, with the outer segments containing a sacrificial abrasive material used to print a barrier along the edges of workspace 110.

A leveling tool 130 is present to distribute the dispensed abrasive mixture evenly along a width 112 of platform. However, as described above, only a partial width 114 may be available for constructing abrasive articles, and partial widths 116 are used to form a sacrificial wall to prevent abrasive material from falling off the sides of platform 110.

In some embodiments leveling blade 130 has an angle with respect to workspace 110 to facilitate movement of powder across width 112. In some embodiments, a second levelling tool is placed near leveling tool 130, as illustrated in FIG. 1. However, in other embodiments only a single leveling tool 130 is present. In one embodiment, the second leveling blade is closer to the platform than the first one and has a different angle.

In some embodiments, a rotating compactor 140 is also present behind leveling tool 130. Rotating leveler 140, in some embodiments, is closer to workspace 110 than levelling tool 130. Rotating leveler 140 increases density of the deposited abrasive material. Density of the deposited abrasive material can directly affect the abrasive performance of a final abrasive article. Depending on the final product, different densities are desired. For example, a less dense, and more porous, bonded abrasive may be useful for abrading operations where large chips are created and need to be removed such as during creep feed grinding or where lubricant is used as the pores can help bring and maintain lubricant at an active grinding area, preventing burning of the workpiece being abraded. More dense bonded abrasive products may be useful when a higher lifetime is requested.

Densification, or compaction, of deposited abrasive material can be accomplished, as illustrated in FIG. 1, by combining a leveling tool 130 and a leveler 140 at different distances from workspace 110. The different distances of leveler 130 and 140 can be adjusted based on the abrasive grit size or precision requested for the final abrasive article. Densification can be further accomplished, for example, using vibration, local compaction or any other suitable method.

In some embodiments, the height of different components can be adjusted during the printing process to increase the printing speed when parts or section can accept a thicker layer. Adjusting the height of different components can increase building speed by keeping the fine details of each component where it is needed.

A binder jet printhead 150 is located behind leveler 140. Binder jet printhead 150 dispenses a binder material on the deposited abrasive mixture in a desired pattern. The binder jet printhead 150 may have several nozzles (not shown in FIG. 1), each of which can dispense binder material. FIG. 1 illustrates a binder jet printhead array 150 with six individual printheads. However, it is expressly contemplated that, in some embodiments there may be only one binder jet printhead 150, fewer than six printheads or more than six printheads. Additionally, while stationary printheads are illustrated in FIG. 1, it is expressly contemplated that one or more printhead 150 may move along an axis defined by the width of platform 110. Movement of printhead 150 can be driven by a step motor having an encoder to know where the nozzles lines are positioned in front of the platform. However, stationary printheads may be advantageous from a programming perspective.

In embodiments where the abrasive mixture includes a binder precursor that will be activated during a later process, binder jet printhead 150 dispenses a temporary binder. In the example of a metal bond or vitreous bond abrasive article, the temporary binder is selected such that it will be burnt out during a later sintering process. In the example of a resin bond abrasive article, for some embodiments, the temporary binder is removed before curing of a high temperature resin, or combined with the resin in the curing process.

Additionally, in some embodiments the temporary binder may remain present in the final abrasive article. The temporary binder may also be included, in some embodiments, in the abrasive mixture and may react with a dispensed liquid material to form a binder. This may reduce the amount of binder that is dispensed through the nozzles.

As illustrated in FIG. 1, binder print jet 150, in one embodiment, is mobile, such that it can move along the axis indicated by arrow 170, such that an entire length of workspace 110 can receive binder material in a desired pattern.

In some embodiments, the binder material is deposited by printhead assembly 150 as a diluted aqueous mixture, solvent based mixture or phenolic based mixture. Binder material is often a naturally viscous material that is not easily dispensed through binder jet nozzle arrays. Dilution reduces a viscosity of the binder to a point where it can be dispensed easily through the nozzles.

The binder material is deposited by an array of nozzles present on printhead 150. In one embodiment, the array of nozzles is a square array of nozzles. The array may have, per printhead, at least about 250 nozzles, in one embodiment, or at least about 500 nozzles, or at least about 800 nozzles, or at least about 1000 nozzles. Dispensing of binder material by the nozzles on printhead 150 is controlled by a controller (not shown in FIG. 1), which determines the number and rate of droplets released from each nozzle based on the intended abrasive articles being printed. For example, the rate of binder dispensation may depend at least in part on: pieces to print, mixture particles sizes, mixture particle material, green strength needed, number of nozzles per printhead 150, nozzle size, droplet frequency, droplet rate, printhead linear speed, layer thickness or other relevant parameters.

In some embodiments, modular assembly 100 can interact with a cleaning station, such that nozzles of binder jet assembly 150 can be periodically cleaned. A cleaning station may be located on a worksurface 110, such that it passes under binder jet assembly 150 in between worksurfaces, or a cleaning station may be located outside of a moving worksurface zone. A parking station (not shown) may also be present.

Also present within assembly 100 is a setting station 160 which facilitates setting of each layer of deposited abrasive material in between layers. Setting may be accomplished by applying a vacuum to remove excess fluid, subjecting the layer to a blower, by thermally drying the layer, thermally curing the layer, UV-curing the layer, or otherwise treating the layer. Setting may also be dictated, at least in part, based on parameters needed for later processing. For example, vitreous abrasive articles or metal bond abrasive articles are made using additive manufacturing require a final sintering step at a high temperature. Additionally, at least some resin-bonded abrasive articles require a final sintering step. The amount of setting needed for each layer of deposited powder is a function of the amount of abrasive material deposited, the heat or other activation agent (e.g. UV light) produced by setting station 160, and the speed of movement of worksurface 110.

While setting station 160 is illustrated in the embodiment of FIG. 1, it is expressly contemplated that, for some abrasive articles, setting may not be needed for each layer. For example, some abrasive articles may only undergo a drying step after all layers, or a subset of layers, are printed. In some embodiments, such as where a reactive temporary binder is included in the abrasive mixture, intermittent drying of each layer is not needed for structural integrity.

A motor will move platform 110 along the direction indicated by arrow 170 during an additive manufacturing process. The motor may operate continuously or discretely.

The finished abrasive article can be removed when the additive manufacturing process is completed.

Movement of worksurface 110 can also be controlled by a step motor. Speed of movement is driven by a number of factors including flowability of the abrasive mixture, binder dispensation and saturation rate, setting time available, and leveling of each layer. The flowability of the abrasive mixture influences the spreading of the powder and, thus, the levelling of each layer without disturbing the previous layer.

Not shown in FIG. 1 is a controller that will drive the operation of different components, positioning of platform 110 and the relative position of each of components 120, 130, 140, 150 and 160 with respect to platform 110. Movement and dispensation rate of printhead 150 will also be dictated by instructions sent from the controller. Movement of step motors and encoders will also be dictated by instructions sent from the controller. Additionally, the controller will also facilitate safety functions to protect both an operator and a machine, including guards, maximum and minimum movement speeds and end switches.

The controller may also, in one embodiment, retrieve and interpret 3D files for the abrasive articles to be printed, such as CAD or STL files. The controller may also interpret the 3D files to determine placement of abrasive articles to be printed on worksurface 110.

Movement of platform 110 is at a continuous rate in direction 170, in one embodiment. In another embodiment, movement is discrete, such that worksurface 110 walks through several discrete positions, during which different operations are performed. In one embodiment, printhead 150 is continuously jetting droplets on the powder bed to generate abrasive articles. In another embodiment, printhead 150 dispenses droplets discretely, such that, in spaces between abrasive material deposition there is no binder dispensed.

While single hopper 120 is illustrated as containing a single homogenous mixture, it is expressly contemplated that, in some embodiments, hopper 120 includes several compartments. Each compartment may contain different abrasive mixtures. For example, in embodiments where sacrificial walls are built as part of the manufacturing process, the portion of an abrasive article near the edges may not need to contain high grade abrasive mineral, which is expensive. Instead, one or more interior compartments close to the edges may contain an abrasive mixture with lower cost materials.

Use of systems described herein, therefore, allow for bonded abrasive articles with abrasive mixtures that can vary from layer to layer, or even between a first and second area in a layer.

Figure 2A:
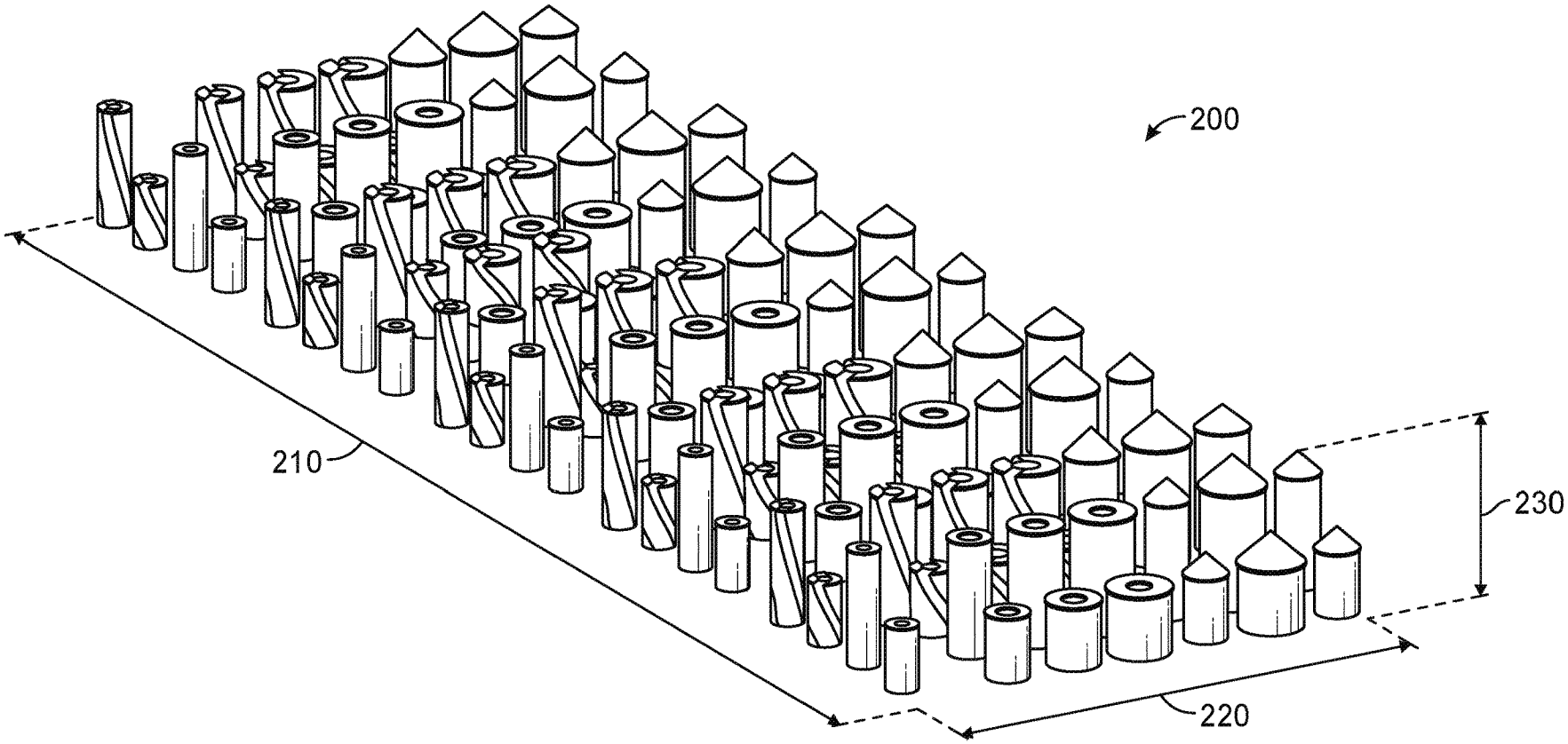
FIGS. 2A and 2B illustrate example arrangements of printed abrasive articles in accordance with various embodiments.
Figure 2B:
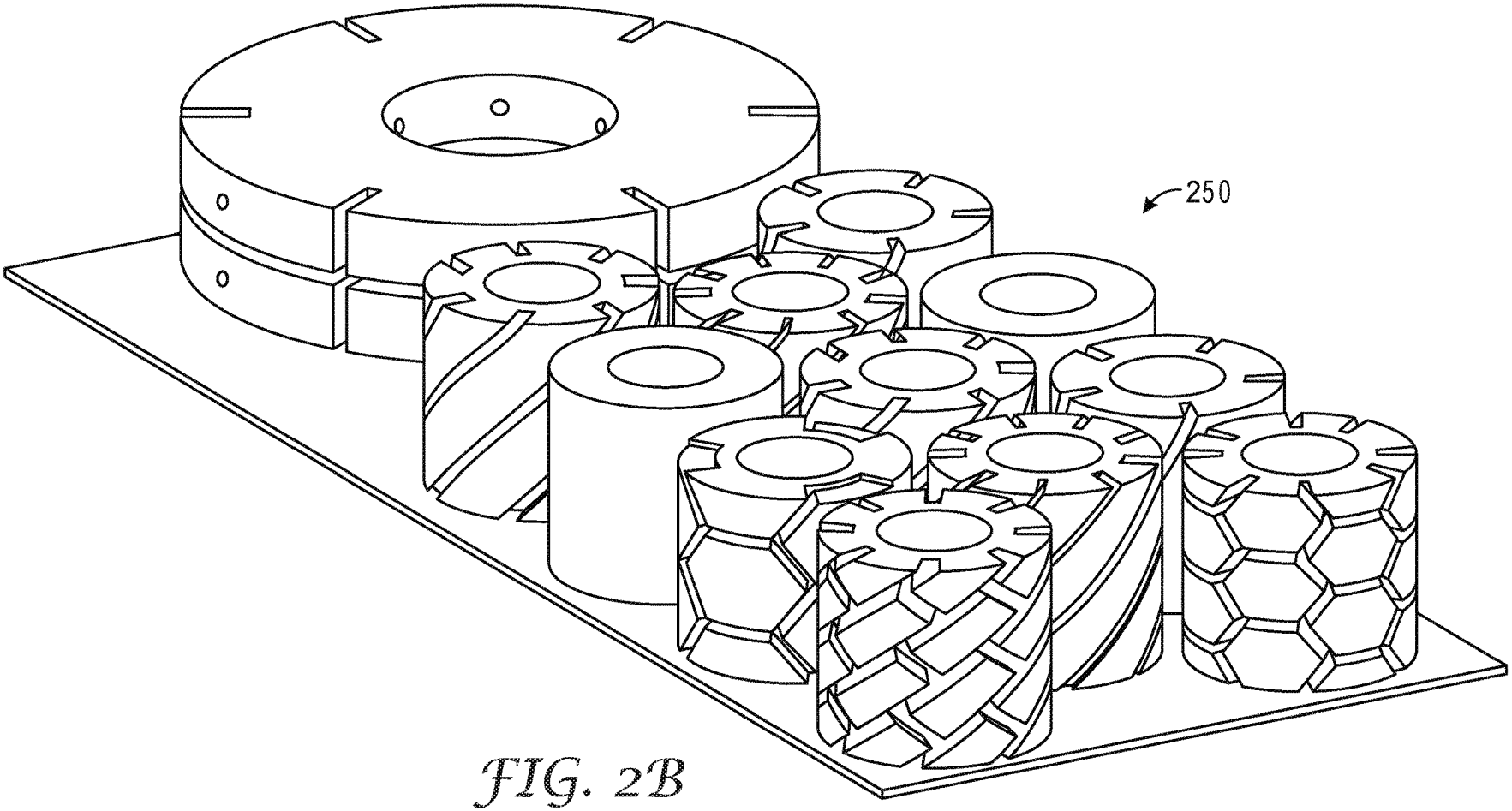

FIGS. 2A and 2B illustrate example arrangements of printed abrasive articles in accordance with various embodiments. Preferably, a combination of abrasive articles are manufactured within a workspace carried by worksurface 110. As illustrated in FIGS. 2A and 2B, different arrangements of different abrasive articles can be assembled on a given workspace 200, 250 during a single additive manufacturing operation. Different shapes and sizes of abrasive articles can be manufactured on a different workspace, so long as all are formed from the same abrasive mixture.

The workspace available for additive manufacturing corresponds to a width of the worksurface, width 112 for example. Length 210 of workspace 200 corresponds to width 112, of FIG. 1, for example. A width 220 of workspace 200 can vary depending on the embodiment. In some embodiments, different workspaces 200 can be arranged such that they sequentially pass under the modular assembly 100.

Figure 3:
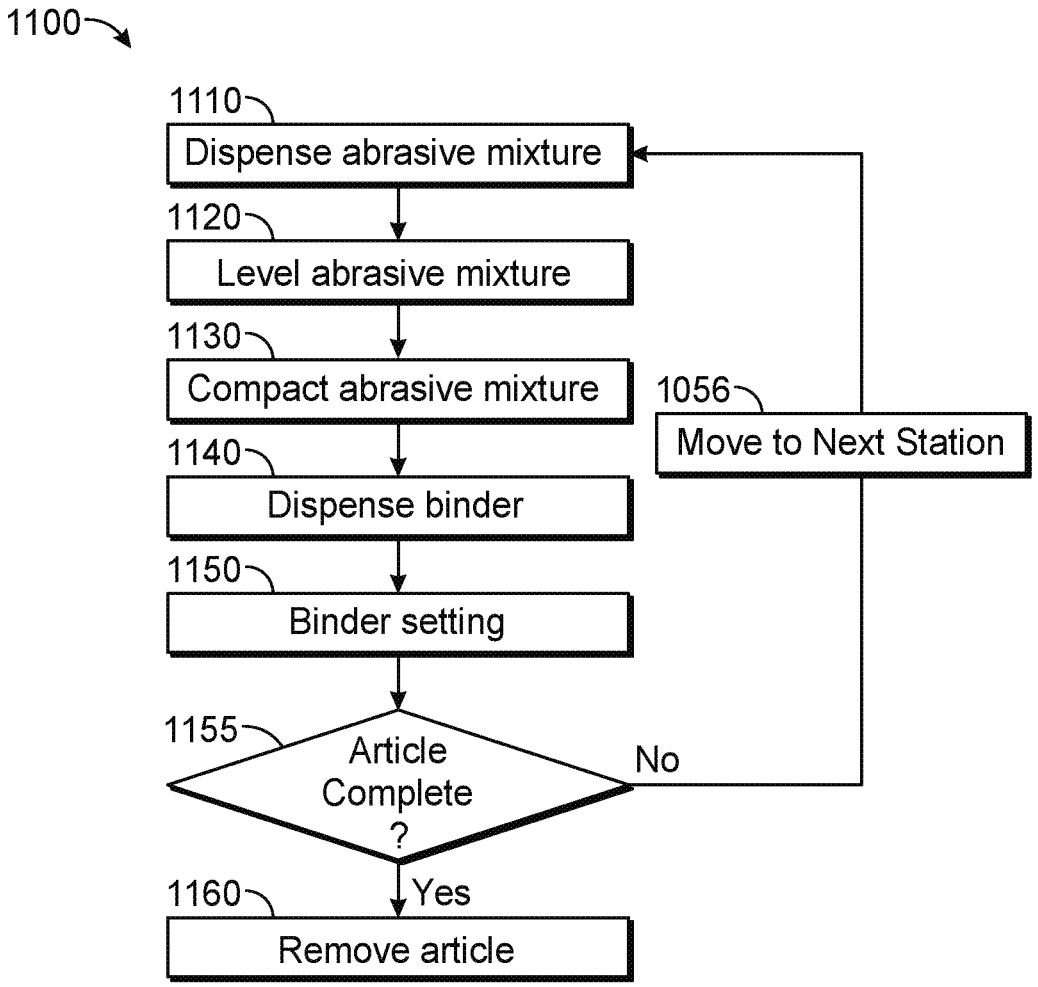
FIG. 3 illustrates a method of manufacturing an abrasive article using a continuous printer in various embodiments.

FIG. 3 illustrates a method of manufacturing an abrasive article using a continuous printer in various embodiments. Method 300 may be suitable with any of the continuous printers of FIGS. 1, 3-4 discussed below, or another suitable continuous printer.

In block 310, an abrasive mixture is dispensed on a workspace. The workspace, in one embodiment, is a moving workspace. The moving workspace can move along an x-axis, on one embodiment, such that it moves below modular assemblies 100. In some embodiments, the workspace can also move in a z-axis direction, closer or further away from a dispensing or compacting height. This can accommodate the increasing height of an abrasive article as additional layers are deposited. The moving workspace may also move in the y-direction, as discussed below, in embodiments where the production line experiences a split. The abrasive mixture may be dispensed on a continuously moving workspace, in one embodiment. In another embodiment the workspace moves discretely between positions, one of which is to receive the abrasive mixture.

The abrasive mixture, in one embodiment, includes abrasive particles, such as shaped, crushed or platey abrasive particles. The abrasive mixture may also include binder precursor particles, in embodiments where a final abrasive article is a vitreous, polymeric, resin or metal-based bond. The abrasive mixture may also include filler material or material that delivers a desired mechanical property to the final abrasive article including porosity, density, or hardness.

In block 320, the abrasive mixture is leveled. Leveling includes spreading out the abrasive mixture to a substantially consistent height across a workspace.

In block 330, the abrasive mixture is compacted. Compacting has an influence on the grinding behavior of a resulting abrasive article and, therefore, may not be required for all embodiments. For example, highly porous structures should not be compacted during manufacture. Compacting can be an important step to increase the density of the final abrasive article. In some embodiments, leveling also includes compacting the abrasive mixture, such that steps 320 and 330 are performed by similar tools, or even performed simultaneously. For example, increasing the bulk green density by 10% on a vitreous bonded abrasive mixture can save 5% porosity after sintering and increase hardness by several degrees. Pre-compacting causes less density decrease than when un-compacted. For example, for completely pressed wheels there may be negligible decrease in density. For additively manufactured abrasive wheels, the decrease may be higher, and compaction may move the density change in between additively manufactured wheels without compaction and closer to pressed wheels.

In block 340, binder material is dispensed. The binder material is dispensed as a liquid from one or more liquid dispensing sources. For example, the binder material may be dispensed by a moving printhead of a binder jet printer, where the binder jet printhead moves across the workspace depositing binder material to create a desired design for the layer of the abrasive article that includes the dispensed abrasive mixture. In another embodiment, the binder material is dispensed by a static dispensing source, such as an array of binder jet printheads, or an array of nozzles. In some embodiments, the binder material is a temporary binder material configured to be removed, or often burnt out, during later setting and firing processes. The binder material may be a dilute binder material, for example in an aqueous, solvent based, phenolic based or other suitable solution.

In block 350, the dispensed binder material undergoes a setting step. The setting step may include heating a workspace, and the layered material on the workspace, to a temperature that allows for curing or setting of the dispensed temporary binder material. Setting may also include thermally drying the dispensed abrasive material and binder on the workspace. Setting may also include UV-curing or other suitable curing mechanism. Setting is an important step to ensure structural integrity of the abrasive article being assembled during deposition of future layers. The method of setting may be selected based on the treatment needed to fix the temporary binder or the amount of binder applied. In the event a dilute binder is used, the water or other solvent may need to be removed, which may also be part of the setting process.

At decision point 355, the abrasive article is either complete, in which case method 300 proceeds to block 360. If the abrasive article is not yet complete, method 300 proceeds to repeat, as indicated in block 355, where another layer of abrasive mixture is deposited. Repeating may include a worksurface passing again underneath a component assembly, in one embodiment. In another embodiment, for example as described in FIGS. 4A-4B, repeating includes the work surface passing underneath a second component assembly.

In block 360, a finished abrasive article is removed from the continuous printer. Removal may include moving the abrasive article off of a workspace and subjecting it to further processing. For example, a vitreous or metal-bonded abrasive article usually undergoes an additional firing process to facilitate melting or sintering of the bond precursor particles and burnout of the temporary binder. Polymer-bonded abrasive articles may also undergo another processing step to facilitate polymerization. Depending on the final product required by the customer, the abrasive product can be glued on a shaft or on a support, can be machined to specific required size, balance, and being marked.

Figure 4A:
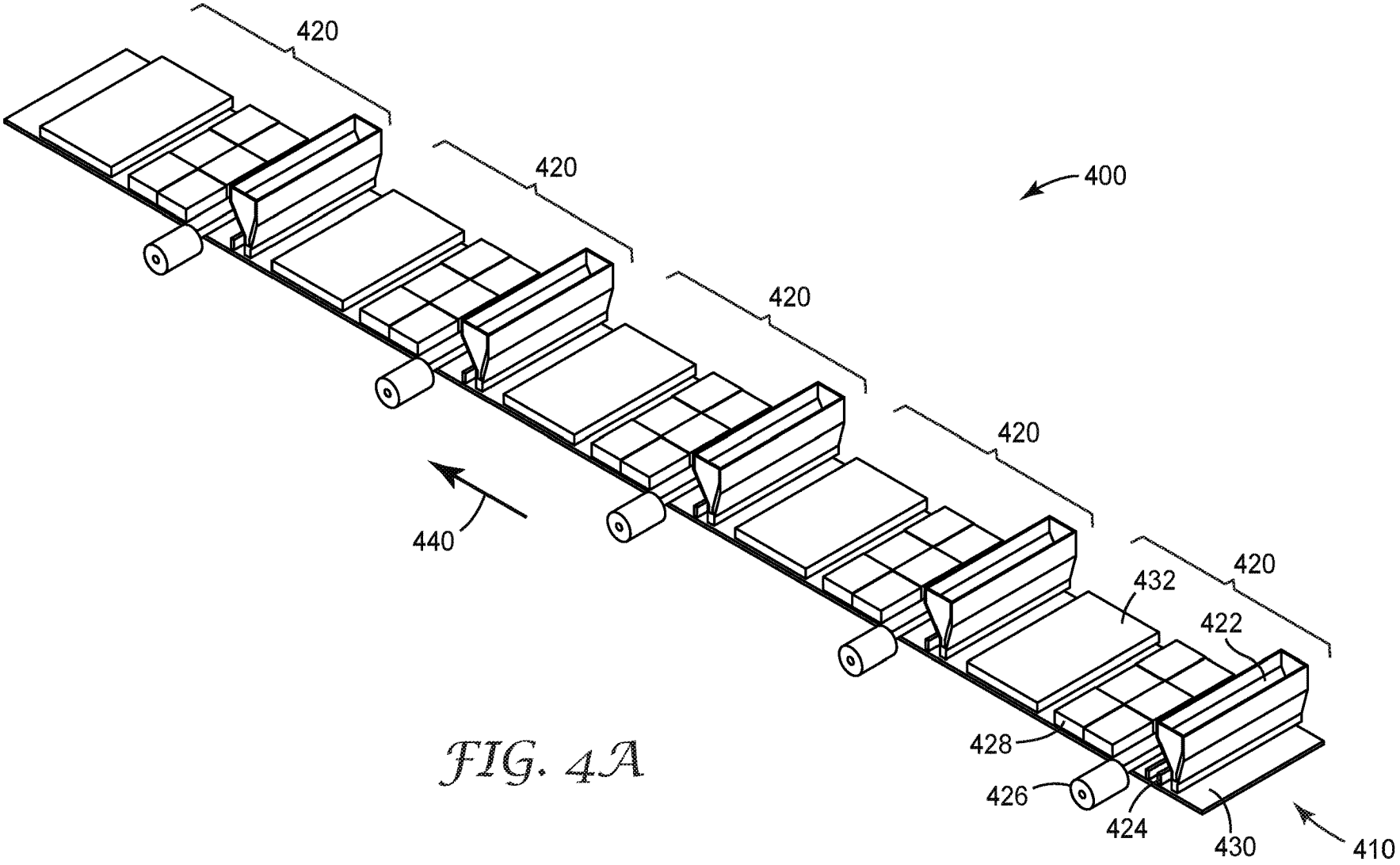
FIGS. 4A and 4B illustrate modular additive manufacturing systems, in accordance with various embodiments.
Figure 4B:
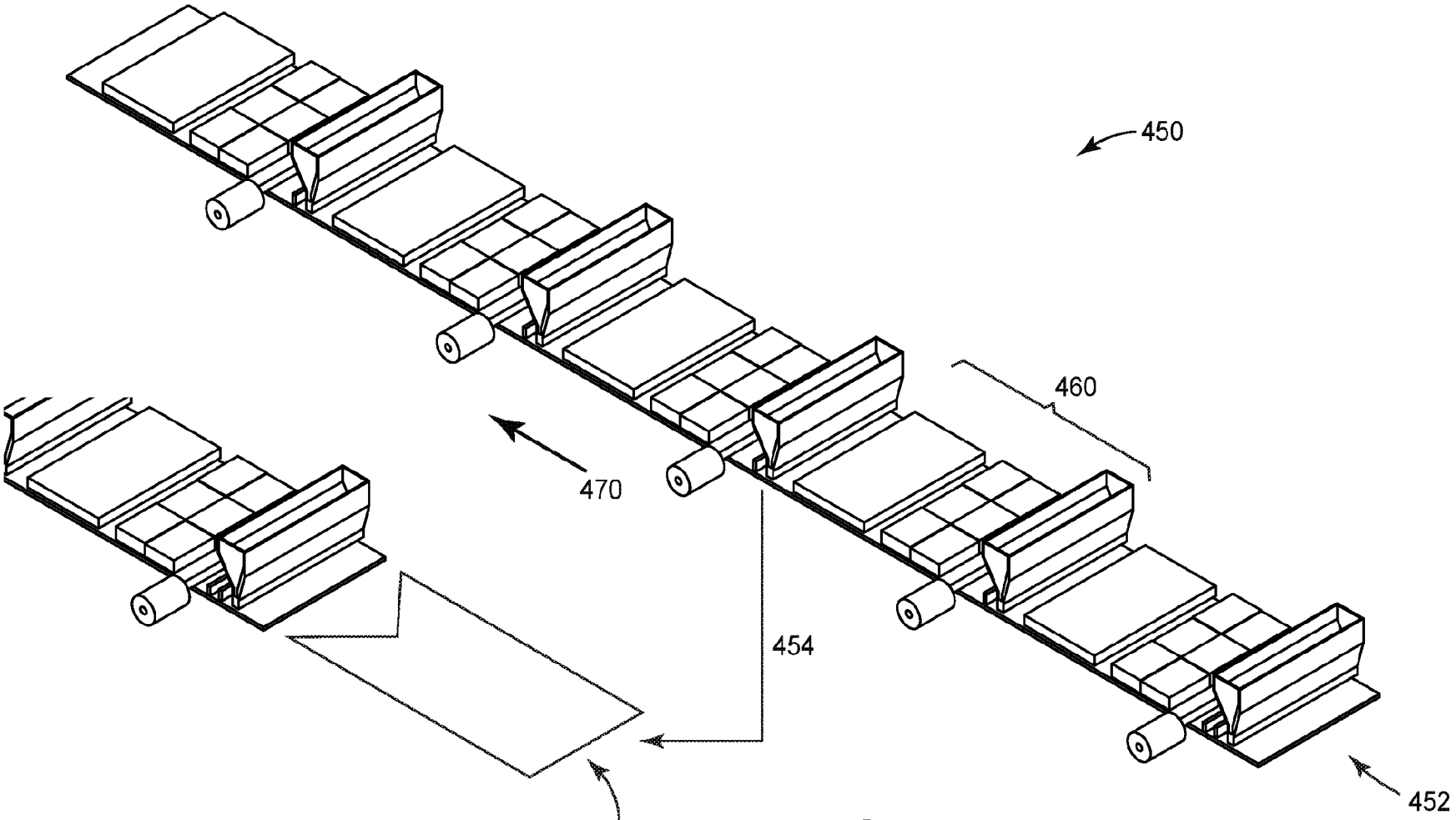

FIGS. 4A and 4B illustrate modular additive manufacturing systems, in accordance with various embodiments. FIG. 4A illustrates a modular additive manufacturing system 400 with a single assembly line 410. Assembly line 410 includes a plurality of modular assembly systems 420 positioned above a workspace 430. Either of modular assembly systems 420 or workspace 430 is moving. In one embodiment, workspace 430 includes a worksurface on a conveyance mechanism that moves in direction 440. However, it is expressly contemplated that, in some embodiments, workspace 430 remains constant and component systems 420 move in a direction opposite direction 440.

An assembly line system such as assembly line 410 allows for better control over the rate limiting step, as multiple modular component assemblies 420 can act in series to increase the overall speed worksurface 430 moves in direction 440. For example, multiple assemblies 420 can be directed toward a rate-limiting step, e.g. leveling and compacting a less flowable abrasive mixture, or dispensing temporary binder mixture. This allows for an overall speed of movement, and thus speed of overall assembly, to increase. For example, one or more subcomponents may not be active in each modular assembly 420. For example, in the embodiment where serial binder jet assemblies 428 are needed to dispense a temporary binder material, it is expressly contemplated that, while a first hopper, leveler and compactor may be active, a second hopper, leveler and compactor may be inactive, such that serially arranged binder jet assemblies 428 dispense onto the same layer of abrasive material.

Additionally, while assemblies 420 are illustrated as modular, it is also expressly contemplated that subcomponents, such as hopper 422, leveler 424, compactor 426, binder jet assembly 428 or setting station 432, may also be modular. For example, in an embodiment where drying is a rate limiting step, multiple setting stations 432 may be placed on assembly line 410 in series, such that worksurface 430 passes under a first setting station 432 and a second setting station 432 before receiving additional abrasive material from a hopper 422.

While FIG. 4A illustrates an assembly system 400 that includes five modular assemblies 420 arranged on a single assembly line 410, other combinations are expressly contemplated. For example, in some embodiments, more or fewer modular assemblies 420 may be needed, for example 2, 3, 4, 10, 20, 30, 40, 50, 60, 70, 80, 90, 100 or more. Additionally, while FIG. 4A illustrates a single assembly line 410, it is expressly contemplated that more complicated systems are possible. For example, FIG. 4B illustrates a more complicated assembly system 450, where a first assembly line 452 splits, creating a second assembly line 456 at a choke point 454. For example, a rate-limiting step may be better addressed not by serial assemblies 460, but by parallel assemblies.

Figure 5:
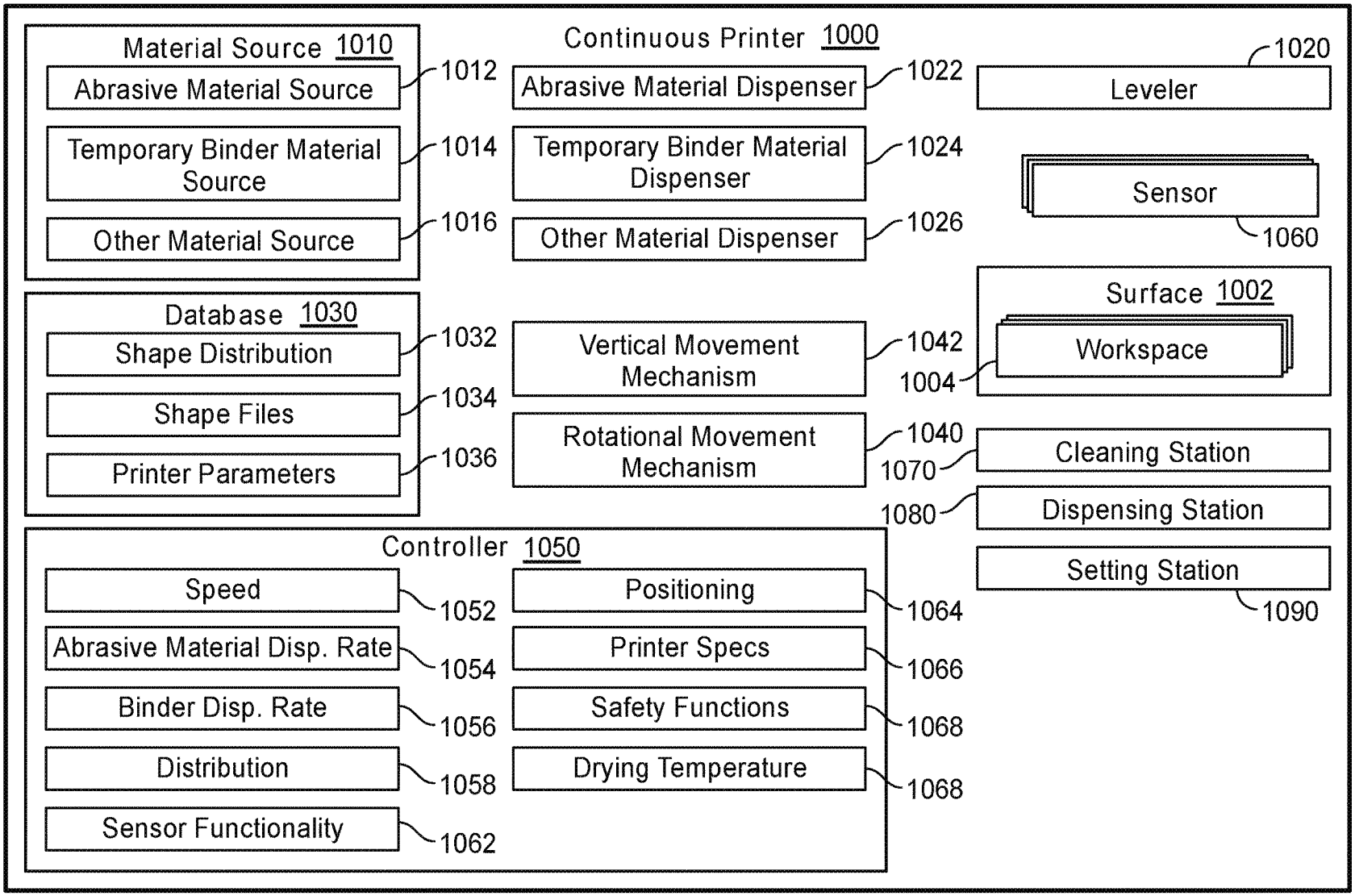
FIG. 5 illustrates a block diagram of a continuous printer in accordance with various embodiments.

FIG. 5 illustrates a block diagram of a continuous printer in accordance with various embodiments. Continuous printer 1002 includes a plurality of printing units 1000 and a workspace 1004. In one embodiment, workspace 1004 moves, using a movement mechanism 1042. Workspace 1004 may also be associated with a conveyance mechanism 1046. Other features 1044, such as physical barriers intended to keep dispensed abrasives from leaving the workspace, may also be present. While workspace 1004 is described, in one embodiment, as moving underneath stationary printing units 1000, it is also envisioned that, in another embodiment, workspace 1004 is stationary and one or more printing units 1000 are moving.

Printing units 1000 may be arranged in a plurality of configurations. For example, printing units 1000 may be linearly arranged, such that a given workspace 1004 moves in relation to each printing unit 1000. In another embodiment, there may be two or more parallel lines 1048 for part, or all of an abrasive operation. For example, continuous printer 1002 may have a split 1049 in a conveyance line such that splits to accommodate a rate limiting step by directing workspaces 1004 successively to each parallel line.

Components of each modular printing unit 1000 are intended to function in a substantially fixed arrangement. As workspace 1004 moves in relation to each printing unit 1000 receives at least one layer of abrasive material and binder, in one embodiment. However, as discussed above, depending on the rate limiting step of a given operation, only one or more components of a given modular printing unit 1000 may be active.

Continuous printer 1002 includes a materials source 1010. A given printing operation may require more material than on-board dispensers of printer 1002 can store. Additional abrasive material can be provided from abrasive material source 1012. Temporary binder material can be provided by a temporary binder material source 1014. Other material, such as filler, can be provided from another material source 1016.

Abrasive material, provided by abrasive material source 1012, includes abrasive particles, which may be shaped, crushed or platey-type abrasive particles. In the embodiment where vitreous abrasive articles are being manufactured, abrasive material source also comprises vitreous bond precursor particles, such as glass frit. In the embodiment where metal bond abrasive articles are being manufactured, abrasive material source also comprises metal bond precursor particles, such as metal powder.

In the embodiments where further processes are required to activate bond precursor materials, a temporary binder material is dispensed in order to hold the abrasive article precursor together during the additive manufacturing process. The temporary binder material is selected such that it will burn out during later processing and not be present in the final article.

Functionality of continuous printer 1002 is controlled by a controller 1050, which may be a processor or microprocessor. Controller 1050, for example, sets and controls a speed 1052 of workspace 1004 with respect to printing units 1000. The rate may be set based on flowability of abrasive material, necessary setting time, binder dispensation rates, or any other suitable parameter.

Controller 1050 controls dispensing of materials onto workspace 1004 by each printing unit 1000. Abrasive material is dispensed by an abrasive material dispenser 1022 at an abrasive material dispensing rate 1054. Abrasive material dispenser may be a hopper, and dispensing may include vibrating the hopper or otherwise causing abrasive material to fall from the hopper onto a workspace 1004.

After a layer of abrasive material is dispensed from abrasive material dispenser 1022, the abrasive material is leveled across workspace 1004 by a leveler 1020. Leveler 1020, in one embodiment, evens out the abrasive material to a substantially even height across workspace 1004. In another embodiment, a leveling mechanism 1020 also provides a compacting operation, causing densification of the abrasive material mixture. The leveler 1020, or levelers 1022, can be at a variable height above workspace 1004. In the embodiment where two or more levelers 1022 are present, the levelers 1022 may be at different heights with respect to each other. Positioning 1064 of the levelers with respect to a workspace is controlled by controller.

The abrasive material mixture is held in place during manufacturing by temporary binder material which is provided by temporary binder material dispenser 1024. Controller 1050 controls the binder dispensing rate 1056, and distribution 1058 of binder along the surface of the dispensed abrasive mixture. Temporary binder material dispenser, in one embodiment, is a jet printhead including an array of nozzles, each nozzle configured to output droplets of binder material onto a given area of workspace 1004. Controller 1050 controls which nozzles output binder material, and at what rate 1056, in order to temporarily bind abrasive material mixture into a desired shape for each layer of an abrasive article being manufactured.

Controller 1050 also controls settings for setting station 1090, including setting parameters 1068. Setting station 1090 is designed such that the binder material dispensed in a current layer on workspace 1004 is sufficiently dried after exposure to setting station 1090 such that another layer of abrasive material mixture can be dispensed by another abrasive material dispenser 1022 of a subsequent printing unit 1000 without causing structural integrity problems.

Controller 1050 also controls other specifications 1066 of each printing unit 1000, and triggers safety function 1068 as needed in order to protect an operator or printer 1002.

Controller 1050 may also cause temporary binder material dispenser 1024, or an entire modular printing unit 1000 to interact with a cleaning station 1070 either periodically, or in response to an alert from a sensor 1060. It is possible that abrasive material will become attached to a nozzle or other dispensing mechanism of temporary binder material dispenser. This can result in a clog, which reduces the precision of binder material dispensing in each layer. Periodically, or in response to a notice of a detected clog from a sensor 1060, controller 1050 may direct temporary binder material dispenser 1024, or an affected portion thereof, to interact with a cleaning station. Cleaning station 1070 may include a brush, a vibrating mechanism, or another device suitable for cleaning off a clogged dispenser.

Controller 1050 directs operation of the components of continuous printer 1000 based on the shapes of abrasive articles being manufactured. Shape information is retrieved from database 1030, which may store shape files 1034, such as CAD or STL files. A distribution of shapes 1032 for a workspace may also be stored in database 1030. Alternatively, controller 1050 may determine a distribution of shapes 1032 based on retrieved shape files 1034 for a given operation. Controller also retrieves printer parameters 1036, such as setting parameters, movement rates, dispensing rates of different material dispensers, and other relevant parameters.

In some embodiments, controller 1050 slices the shape file 1034 into layers, such that individual instructions can be sent to each printing unit 1000 based on the layer that unit 1000 will deposit. Controller 1050 may also check to determine that the layers, and formed abrasive articles, will fit within the confines of workspace 1004, and make adjustments as necessary.

Controller 1050 also controls a pre-assembly check of all components, ensuring that the zero position of each machine is noted and adjusted if needed. Controller 1050 will also verify presence of air pressure and binder solution in printheads, ensure there is cleaner in the cleaning station, and sufficient binder and cleaner for refilling, and sufficient space in a waste stream for a given project. Similar checks may be run at machine start-up and before a manufacturing process begins.

Controller 1050 also controls movement mechanisms 1041 and 1042. Movement mechanisms may be any suitable motor, such as a step motor, operating discretely or continuously. Movement mechanism 1042 causes workspace 1004 to interact with each printing unit 1000, and each subcomponent of a given printing unit 1000. Movement mechanism(s) 1041 may be responsible for moving one or more components of a printing unit 1000, such as a relative height of a leveler 1020, or a relative height of printing unit 1000. For example, as an abrasive article grows on workspace 1004 as layers of abrasive material and binder are dispensed. Therefore, a relative height of each component of a printing unit 1000 at an end of an assembly line may need to be different than a height of a printing unit 1000 at the beginning of an assembly line.

Controller 1050 also controls a variety of sensors 1060 that may be present within continuous printer 1000. Sensors 1060 may be optical, cameras, or thermometers, for example. Sensors can be used to measure quality control of abrasive articles during assembly, including monitoring curing of temporary binder, measuring hardness, porosity and/or density of abrasive article as well as other mechanical properties. Sensors 1060 are envisioned as including any in-line measurement that can help with quality control. Sensors 1060 may also monitor fill levels for abrasive material dispenser 1022, temporary binder material dispenser 1024, and other material dispenser 1026, such that additional material can be provided by a material source 1010 as needed.

In creating the part layer by layer, one of the challenges is the time needed to build each layer, reducing the range of potential products that are cost effective.

Described herein is a 3D-printing continuous process, where all the steps are done together at the same time. This can reduce the layer building time by more than half and increase the throughput of the printer. Additionally, several parts can be made simultaneously on the same workspace, further reducing a per-part time to manufacture. While the discussion below focusses on powder bed binder jetting, other additive manufacturing techniques, such as powder bed fusion, may also be implemented using systems and methods described herein.

Powder bed binder jetting is a process where a thin layer of a powder is spread out evenly and then is partially bonded at desired locations by a liquid binder mixture. Typically, that binder mixture is dispensed by an inkjet print head and consists of a polymer dissolved in a suitable solvent or carrier solution. The role of the binder is to fix each particle in place, keeping the homogeneity of the mixture and forming the expected shape of the final article in a layer-by-layer process. The first layer then is at least partially dried and lowered so that a next powder layer is spread. The powder spreading, layer levelling, bonding and setting processes can be repeated until the full object is created. These 4 steps are usually done sequentially for a given abrasive layer.

The abrasive article precursor and surrounding powder is removed from the printer and often dried or cured to impart additional strength so that the now hardened object can be extracted from the surrounding powder.

In some cases, the powder in the object can be in a matrix form so that another material can be infused or infiltrated in a subsequent step to create a fully dense object.

The time needed for each different step is highly dependent on the abrasive mixture being printed. A highly flowable powder can be spread and levelled much faster than a mixture having a poor flowability behavior. A highly conductive powder can be heated and dried faster than a refractory or ceramic material. Printing time is usually driven by the abrasive mixture but also by the precision needed for the final abrasive product. The precision needed determines the thickness possible for each abrasive layer. Printing time can also increase depending on the needed strength to handle the printed part before a final consolidation step.

Shaped Abrasive Particles

As used herein "shaped abrasive particle" means an abrasive particle having a predetermined or non-random shape. One process to make a shaped abrasive particle such as a shaped ceramic abrasive particle includes shaping the precursor ceramic abrasive particle in a mold having a predetermined shape to make ceramic shaped abrasive particles. Ceramic shaped abrasive particles, formed in a mold, are one species in the genus of shaped ceramic abrasive particles. Other processes to make other species of shaped ceramic abrasive particles include extruding the precursor ceramic abrasive particle through an orifice having a predetermined shape, printing the precursor ceramic abrasive particle though an opening in a printing screen having a predetermined shape, or embossing the precursor ceramic abrasive particle into a predetermined shape or pattern. In other examples, the shaped ceramic abrasive particles can be cut from a sheet into individual particles. Examples of suitable cutting methods include mechanical cutting, laser cutting, or water-jet cutting. Non-limiting examples of shaped ceramic abrasive particles include shaped abrasive particles, such as triangular plates, tetrahedral abrasive particles, elongated ceramic rods/filaments, or other shaped abrasive particles. Shaped ceramic abrasive particles are generally homogenous or substantially uniform and maintain their sintered shape without the use of a binder such as an organic or inorganic binder that bonds smaller abrasive particles into an agglomerated structure and excludes abrasive particles obtained by a crushing or comminution process that produces abrasive particles of random size and shape. In many embodiments, the shaped ceramic abrasive particles comprise a homogeneous structure of sintered alpha alumina or consist essentially of sintered alpha alumina. Any of shaped abrasive particles can include any number of shape features. The shape features can help to improve the cutting performance of any of shaped abrasive particles. Examples of suitable shape features include an opening, a concave surface, a convex surface, a groove, a ridge, a fractured surface, a low roundness factor, or a perimeter comprising one or more corner points having a sharp tip. Individual shaped abrasive particles can include any one or more of these features.

The abrasive may include conventional (e.g., crushed) abrasive particles. Examples of useful abrasive particles include fused aluminum oxide-based materials such as aluminum oxide, ceramic aluminum oxide (which can include one or more metal oxide modifiers and/or seeding or nucleating agents), and heat-treated aluminum oxide, silicon carbide, co-fused alumina-zirconia, diamond, ceria, titanium diboride, cubic boron nitride, boron carbide, garnet, flint, emery, sol-gel derived abrasive particles, and mixtures thereof. The conventional abrasive particles can, for example, have an average diameter ranging from about 10

μm to about 2000 μm, about 20 μm to about 1300 μm, about 50 μm to about 1000 μm, less than, equal to, or greater than about 10 μm, 20, 30, 40, 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1650, 1700, 1750, 1800, 1850, 1900, 1950, or 2000 μm. For example, the conventional abrasive particles can have an abrasives industry-specified nominal grade. Such abrasives industry-accepted grading standards include those known as the American National Standards Institute, Inc. (ANSI) standards, Federation of European Producers of Abrasive Products (FEPA) standards, and Japanese Industrial Standard (HS) standards. Exemplary ANSI grade designations (e.g., specified nominal grades) include: ANSI 12 (1842 μm), ANSI 16 (1320 μm), ANSI 20 (905 μm), ANSI 24 (728 μm), ANSI 36 (530 μm), ANSI 40 (420 μm), ANSI 50 (351 μm), ANSI 60 (264 μm), ANSI 80 (195 μm), ANSI 100 (141 μm), ANSI 120 (116 μm), ANSI 150 (93 μm), ANSI 180 (78 μm), ANSI 220 (66 μm), ANSI 240 (53 μm), ANSI 280 (44 μm), ANSI 320 (46 μm), ANSI 360 (30 μm), ANSI 400 (24 μm), and ANSI 600 (16 μm). Exemplary FEPA grade designations include P12 (1746 μm), P16 (1320 μm), P20 (984 μm), P24 (728 μm), P30 (630 μm), P36 (530 μm), P40 (420 μm), P50 (326 μm), P60 (264 μm), P80 (195 μm), P100 (156 μm), P120 (127 μm), P150 (97 μm), P180 (78 μm), P220 (66 μm), P240 (60 μm), P280 (53 μm), P320 (46 μm), P360 (41 μm), P400 (36 μm), P500 (30 μm), P600 (26 μm), and P800 (22 μm). An approximate average particles size of reach grade is listed in parenthesis following each grade designation.

Shaped abrasive particles or crushed abrasive particles can include any suitable material or mixture of materials. For example, shaped abrasive particles can include a material chosen from an alpha-alumina, a fused aluminum oxide, a heat-treated aluminum oxide, a ceramic aluminum oxide, a sintered aluminum oxide, a silicon carbide, a titanium diboride, a boron carbide, a tungsten carbide, a titanium carbide, a diamond, a cubic boron nitride, a garnet, a fused alumina-zirconia, a sol-gel derived abrasive particle, a cerium oxide, a zirconium oxide, a titanium oxide, and combinations thereof. In some embodiments, shaped abrasive particles and crushed abrasive particles can include the same materials. In further embodiments, shaped abrasive particles and crushed abrasive particles can include different materials.

Filler particles can also be included in abrasive. Examples of useful fillers include metal carbonates (such as calcium carbonate, calcium magnesium carbonate, sodium carbonate, magnesium carbonate), silica (such as quartz, glass beads, glass bubbles and glass fibers), silicates (such as talc, clays, montmorillonite, feldspar, mica, calcium silicate, calcium metasilicate, sodium aluminosilicate, sodium silicate), metal sulfates (such as calcium sulfate, barium sulfate, sodium sulfate, aluminum sodium sulfate, aluminum sulfate), gypsum, vermiculite, sugar, wood flour, a hydrated aluminum compound, carbon black, metal oxides (such as calcium oxide, aluminum oxide, tin oxide, titanium dioxide), metal sulfites (such as calcium sulfite), thermoplastic particles (such as polycarbonate, polyetherimide, polyester, polyethylene, poly(vinylchloride), polysulfone, polystyrene, acrylonitrile-butadiene-styrene block copolymer, polypropylene, acetal polymers, polyurethanes, nylon particles), thermosetting particles (such as phenolic bubbles, phenolic beads, polyurethane foam particles and the like) and natural gum (such as Arabic gum, Acacia gum, etc.). The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metal fillers include, tin, lead, bismuth, cobalt, antimony, cadmium, iron and titanium. Other miscellaneous fillers include sulfur, organic sulfur compounds, graphite, lithium stearate and metallic sulfides. In some embodiments, individual shaped abrasive particles or individual crushed abrasive particles can be at least partially coated with an amorphous, ceramic, or organic coating. Examples of suitable components of the coatings include, a silane, glass, iron oxide, aluminum oxide, or combinations thereof. Coatings such as these can aid in processability and bonding of the particles to a resin of a binder.

Magnetic Abrasive Orientation

It is expressly contemplated that abrasive material dispensed in embodiments herein may include particles that can be oriented. For example, precision shaped particles, such as triangular shaped particles, may be designed to provide different abrasive function when oriented with a tip facing a workpiece, than if an edge or a face faced the workpiece. While magnetic orientation is described in detail herein, other suitable orientation methods are expressly contemplated for other embodiments. Additionally, no orientation may be present, in some embodiments.

At least one magnetic material may be included within or coated to abrasive particles. Examples of magnetic materials include iron; cobalt; nickel; various alloys of nickel and iron marketed as Permalloy in various grades; various alloys of iron, nickel and cobalt marketed as Fernico, Kovar, FerNiCo I, or FerNiCo II; various alloys of iron, aluminum, nickel, cobalt, and sometimes also copper and/or titanium marketed as Alnico in various grades; alloys of iron, silicon, and aluminum (about 85:9:6 by weight) marketed as Sendust alloy; Heusler alloys (e.g., $Cu_2MnSn$); manganese bismuthide (also known as Bismanol); rare earth magnetizable materials such as gadolinium, dysprosium, holmium, europium oxide, alloys of neodymium, iron and boron (e.g., $Nd_2Fe_{14}B$), and alloys of samarium and cobalt (e.g., $SmCo_5$); MnSb; $MnOFe_2O_3$; $Y_3Fe_5O_{12}$; $CrO_2$; MnAs; ferrites such as ferrite, magnetite; zinc ferrite; nickel ferrite; cobalt ferrite, magnesium ferrite, barium ferrite, and strontium ferrite; yttrium iron garnet; and combinations of the foregoing. In some embodiments, the magnetizable material is an alloy containing 8 to 12 weight percent aluminum, 15 to 26 wt % nickel, 5 to 24 wt % cobalt, up to 6 wt % copper, up to 1% titanium, wherein the balance of material to add up to 100 wt % is iron. In some other embodiments, a magnetizable coating can be deposited on an abrasive particle 100 using a vapor deposition technique such as, for example, physical vapor deposition (PVD) including magnetron sputtering. Including these magnetizable materials can allow shaped abrasive particles to be responsive a magnetic field. Any of shaped abrasive particles can include the same material or include different materials.

Applied magnetic fields used in practice of the present disclosure have a field strength in the region of the magnetizable particles being affected (e.g., attracted and/or oriented) of at least about 10 gauss (1 mT), at least about 100 gauss (10 mT), or at least about 1000 gauss (0.1 T), although this is not a requirement. The applied magnetic field can be provided by one or more permanent magnets and/or electromagnet(s), or a combination of magnets and ferromagnetic members, for example. Suitable permanent magnets include rare-earth magnets comprising magnetizable materials are described hereinabove. The applied magnetic field can be static or variable (e.g., oscillating). Upper or lower magnetic members may be used, each having north (N) and south (S) poles, where each magnetic member be monolithic or may be composed of multiple component magnets and/or magnetizable bodies, for example. If comprised of multiple magnets, the multiple magnets in a given magnetic member can be contiguous and/or co-aligned (e.g., at least substantially parallel) with respect to their magnetic field lines where the components magnets closest approach each other. Stainless steel retainers may be used to retain the magnets in position. While stainless steel or an equivalent is suitable due to its non-magnetic character, magnetizable materials may also be used. Mild steel mounts may be used to support stainless steel retainers.

Once the magnetizable abrasive particles are dispensed onto the curable binder precursor, the binder may be cured at least partially at a first curing station (not shown), so as to firmly retain the magnetizable particles in position. In some embodiments, additional magnetizable and/or non-magnetizable particles (e.g., filler abrasive particle and/or grinding aid particles) can be applied to the make layer precursor prior to curing. In the case of a coated abrasive article, the curable binder precursor comprises a make layer precursor, and the magnetizable particles comprise magnetizable abrasive particles. A size layer precursor may be applied over the at least partially cured make layer precursor and the magnetizable abrasive particles, although this is not a requirement. If present, the size layer precursor is then at least partially cured at a second curing station, optionally with further curing of the at least partially cured make layer precursor. In some embodiments, a supersize layer is disposed on the at least partially cured size layer precursor.

Abrasive Placement

The shaped abrasive particles described herein may have a specified z-direction rotational orientation about a z-axis passing through shaped abrasive particles, where the z-axis of the abrasive may be substantially perpendicular to the wheel substrate. Shaped abrasive particles are orientated with a surface feature, such as a substantially planar surface particle, rotated into a specified angular position about the z-axis. The specified z-direction rotational orientation abrasive wheel occurs more frequently than would occur by a random z-directional rotational orientation of the surface feature due to electrostatic coating or drop coating of the shaped abrasive particles when forming the abrasive wheel. As such, by controlling the z-direction rotational orientation of a significantly large number of shaped abrasive particles, the cut rate, finish, or both of coated abrasive wheel can be varied from those manufactured using an electrostatic coating method. In various embodiments, at least 50, 51, 55, 60, 65, 70, 75, 80, 85, 90, 95, or 99 percent of shaped abrasive particles can have a specified z-direction rotational orientation which does not occur randomly and which can be substantially the same for all of the aligned particles. In other embodiments, about 50 percent of shaped abrasive particles can be aligned in a first direction and about 50 percent of shaped abrasive particles can be aligned in a second direction. In one embodiment, the first direction is substantially orthogonal to the second direction.

The specific z-direction rotational orientation of formed abrasive particles can be achieved through use of a precision apertured screen that positions shaped abrasive particles into a specific z-direction rotational orientation such that shaped abrasive particles can only fit into the precision apertured screen in a few specific orientations such as less than or equal to 4, 3, 2, or 1 orientations. For example, a rectangular opening just slightly bigger than the cross section of shaped abrasive particles comprising a rectangular plate will orient shaped abrasive particles in one of two possible 180 degree opposed z-direction rotational orientations. The precision apertured screen can be designed such that shaped abrasive particles, while positioned in the screen's apertures, can rotate about their z-axis (normal to the screen's surface when the formed abrasive particles are positioned in the aperture) less than or equal to about 30, 20, 10, 5, 2, or 1 angular degrees.

The precision apertured screen, having a plurality of apertures selected to z-directionally orient shaped abrasive particles into a pattern, may include an abrasive retainer. The abrasive retainer may include an adhesive tape on a second precision apertured screen with a matching aperture pattern, an electrostatic field used to hold the particles in the first precision screen, a mechanical lock such as two precision apertured screens with matching aperture patterns twisted in opposite directions to pinch particles within the apertures, or other retentive mechanism. The first precision aperture screen may be filled with shaped abrasive particles, and the retaining member is used to hold shaped abrasive particles in place in the apertures. In one embodiment, adhesive tape on the surface of a second precision aperture screen aligned in a stack with the first precision aperture screen causes shaped abrasive particles to be retained in the apertures of the first precision screen stuck to the surface of the tape exposed in the second precision aperture screen's apertures.

Following positioning in apertures, a coated backing having make layer may be positioned parallel to the first precision aperture screen surface containing the shaped abrasive particles with make layer facing shaped abrasive particles in the apertures. Thereafter, coated backing and the first precision aperture screen are brought into contact to adhere shaped abrasive particles to the make layer. The retaining member is released such as removing the second precision aperture screen with taped surface, untwisting the two precision aperture screens, or eliminating the electrostatic field. Then the first precision aperture screen is then removed leaving the shaped abrasive particles having a specified z-directional rotational orientation on the coated abrasive article for further conventional processing such as applying a size coat and curing the make and size coats.

A method of forming an abrasive article is presented. The method includes depositing a layer of an abrasive mixture onto a dispensing surface from an abrasive mixture dispenser at an abrasive mixture depositing location. The method also includes leveling the layer of the abrasive mixture at a leveling location, using a leveling tool, such that the layer has a substantially smooth surface. The method also includes applying a liquid material, from a liquid dispenser at a liquid dispensing station, to the compacted layer of abrasive mixture. The method also includes allowing the layer of abrasive mixture and dispensed liquid to set at a setting station. The method also includes repeating the steps of depositing, leveling, applying and setting to form a multilayered abrasive article. The dispensing surface is configured to move with respect the depositing location, the leveling location, the compacting station, the liquid dispensing station and the setting station.

The method may be implemented such that it also includes compacting the layer of the abrasive mixture, using a compacting tool at a compacting location, such that a density of the layer of abrasive mixture increases.

The method may also be implemented such that the abrasive mixture dispenser, the leveling tool, the compacting tool, the liquid dispenser and the setting station are parts of a first modular assembly.

The method may also be implemented such that the step of repeating includes the dispensing surface moving with respect to a second modular assembly.

The method may also be implemented such that the first modular assembly includes a second setting station.

The method may also be implemented such that the applied liquid material is a temporary binder configured to be burnt out during later processing of the abrasive article.

The method may also be implemented such that the abrasive mixture includes a permanent binder precursor, and the permanent binder precursor is configured to be activated during later processing of the abrasive article.

The method may also be implemented such that the permanent binder precursor includes glass frit.

The method may also be implemented such that the applied liquid material is a reactive agent that reacts with a compound of the abrasive mixture.

The method may also be implemented such that the liquid dispenser is a binder jet dispenser.

The method may also be implemented such that the binder jet dispenser is an array of multiple printheads.

The method may also be implemented such that the binder jet dispenser is configured to move along a dimension of the dispensing surface.

The method may also be implemented such that the dimension is a dimension other than the dimension along with the dispensing surface moves with respect to the modular assembly.

The method may also be implemented such that the binder jet dispenser remains stationary.

The method may also be implemented such that the array of printheads includes at least 1,000 nozzles.

The method may also be implemented such that the liquid material is applied in a pattern on the compacted layer of abrasive mixture such that at least a portion of the compacted layer receives no liquid material.

The method may also be implemented such that the liquid material is applied in subsequent layers in a pattern such that a channel is formed through the abrasive article.

The method may also be implemented such that the channel is an arcuate, tortuous or straight channel extending at least partway through the abrasive article.

The method may also be implemented such that the abrasive article includes abrasive material in a spiral pattern.

The method may also be implemented such that the abrasive article is an abrasive wheel.

The method may also be implemented such that the abrasive article is a plurality of discrete abrasive articles, and a first discrete abrasive article is different than a second discrete abrasive article.

The method may also be implemented such that the abrasive material dispenser includes a first compartment and a second compartment and the first compartment contains a first abrasive mixture and the second compartment contains a second abrasive mixture.

The method may also be implemented such that it also includes orienting a plurality of abrasive particles within the layer of abrasive mixture.

A system for forming an abrasive article includes a workspace and an abrasive material dispenser that deposits a layer of abrasive material onto the workspace. The system also includes a leveler that levels a surface of abrasive material on the workspace. The system also includes a binder jet printer that dispenses a liquid binder onto the layer of abrasive material. The workspace is on a moving surface that moves the workspace between a dispensing position under the dispenser, a leveling position under the leveler, and a printing position, under the printer.

The system may also be implemented such that it includes a setting station that at least partially dries the liquid binder.

The system may also be implemented such that the abrasive material dispenser, leveler, and setting station remain substantially in place with respect to each other.

The system may also be implemented such that the setting station includes one of: a UV curing station, a vacuum station, a blower, a thermal drying station or a thermal curing station.

The system may also be implemented such that the leveler is at an adjustable height with respect to the workspace.

The system may also be implemented such that it includes a compactor that applies a force to the surface of abrasive material and increase a density of the layer of abrasive material.

The system may also be implemented such that it includes a densification station.

The system may also be implemented such that the densification station includes one of: a rotating compactor, a stamper, or a vibratory unit.

The system may also be implemented such that the liquid binder is an aqueous mixture.

The system may also be implemented such that the abrasive material includes binder precursor particles configured to be activated during later processing of the abrasive article. The liquid binder may be a temporary binder configured to be burnt out of the abrasive article during later processing.

The system may also be implemented such that the surface is continuously moving between the dispensing position, the leveling position, and the printing position.

The system of claim 1, wherein the surface moves discretely between the dispensing position, the leveling position, and the printing position.

The system may also be implemented such that the surface is a rectangular surface.

The system may also be implemented such that the surface is coupled to a movement mechanism, such that the surface moves beneath each of the abrasive material dispenser, leveler and binder jet printer.

The system may also be implemented such that the surface is stationary. Each of the abrasive material dispenser, leveler and binder jet printer may be coupled to a movement mechanism such that each of the abrasive material dispenser, leveler and binder jet printer move over the surface.

The system may also be implemented such that the abrasive material dispenser, the leveler and the binder jet printer are part of a first printing assembly, and wherein the system includes a second printing assembly, in series with the first printing assembly. The second printing assembly may include a second abrasive material dispenser that deposits a second layer of abrasive material onto the workspace, a second leveler that levels a surface of the second layer of abrasive material on the workspace, a second binder jet printer that dispenses a second layer of liquid binder onto the second layer of abrasive material.

The system may also be implemented such that the second abrasive material dispenser contains a second abrasive material mixture, the abrasive material dispenser contains a first abrasive material mixture, and wherein the first and second abrasive material mixtures are different.

The system may also be implemented such that the first binder jet printer dispenses the first layer of liquid binder in a first pattern, the second binder jet printer dispenses the second layer of liquid binder in a second pattern, and the second pattern is different from the first pattern.

The system may also be implemented such that the second pattern contains a portion that is offset from a corresponding portion of the first pattern.

The system may also be implemented such that the first abrasive material dispenser dispenses a homogenous abrasive mixture across the workspace.

The system may also be implemented such that the first abrasive material dispenser dispenses a non-homogenous abrasive mixture across the workspace.

The system may also be implemented such that it includes a magnetic orientation unit configured to orient particles within the layer of abrasive material.

An additive manufacturing system includes a printing workspace that moves relative to a series of printing assemblies. Each of the printing assemblies is a modular printing assembly comprising a particle dispensing unit and a liquid dispensing unit. Each of the series of printing assemblies deposits a layer on the printing workspace such that, after the printing workspace passes through the series of printing assemblies, an article is formed.

The system may also be implemented such that the printing workspace is coupled to a movement mechanism such that the printing workspace moves under each of the printing assemblies.

The system may also be implemented such that each of the printing assemblies is coupled to a movement mechanism such that each of the printing assemblies passes over the printing workspace.

The system may also be implemented such that the particle dispensing unit is configured to dispense a particle mixture.

The system may also be implemented such that the particle dispensing unit is configured to dispense the particle mixture and a second particle mixture.

The system may also be implemented such that the second particle mixture is a sacrificial particle mixture.

The system may also be implemented such that the liquid dispensing unit includes a binding material dissolved in solvent.

The system may also be implemented such that the solvent is an aqueous mixture.

The system may also be implemented such that the liquid dispensing unit dispenses a phenolic mixture.

The system may also be implemented such that at least one of the modular printing assemblies includes a leveler.

The system may also be implemented such that at least one of the modular printing assemblies includes a densification unit.

The system may also be implemented such that the densification unit includes a vibratory unit, a stamping unit, or a rotating compactor.

The system may also be implemented such that at least one of the modular printing assemblies includes a setting unit.

The system may also be implemented such that the setting station includes a UV curing unit, a vacuum, a blower, a thermal drying station or a thermal curing station.

The system may also be implemented such that it includes an orientation station configured to impart an orientation to particles dispensed by the particle dispensing unit.

The system may also be implemented such that the orientation station is an electrostatic orientation station.

The system may also be implemented such that the orientation station is a magnetic orientation station, and wherein dispensed particles are responsive to a magnetic field.

The system may also be implemented such that it includes a leveler configured to level a layer of particles dispensed by the particle dispenser.

The system may also be implemented such that the article is an abrasive article.

The system may also be implemented such that the article is a vitreous, resin or metal bonded abrasive article.

The system may also be implemented such that the article is a coated abrasive article.

The system may also be implemented such that the abrasive article includes abrasive particles, dispensed by the particle dispensing unit, and binder material dispensed by the liquid dispensing unit.

The system may also be implemented such that the particle dispensing unit dispenses a particle mixture that includes the abrasive particles.

The system may also be implemented such that the particle mixture also includes filler particles.

The system wherein the particle mixture also includes binder precursor particles, and wherein the liquid dispenser dispenses a temporary binder.

The system may also be implemented such that the abrasive particles include crushed, platey, formed or shaped abrasive grains.

The system may also be implemented such that the particle dispensing unit dispenses a first particle mixture and a second particle mixture.

The system may also be implemented such that the first particle mixture includes a first plurality of abrasive particles, and the second mixture includes a second plurality of abrasive particles, and wherein the first and second plurality of abrasive particles differ in at least one of: composition, shape, or size.

The system may also be implemented such that a first printing assembly and a second printing assembly are arranged in parallel to each other.

The system may also be implemented such that a first printing assembly and a second printing assembly are arranged in series with respect to each other.

The system may also be implemented such that the liquid dispenser is a binder jet printer.

The system may also be implemented such that the binder jet printer is a binder jet printing assembly.

It is recognized that various modifications are possible within the scope of the embodiments of the present disclosure. Thus, it should be understood that although the present disclosure has been specifically disclosed by specific embodiments and optional features, modification and variation of the concepts herein disclosed may be resorted to by those of ordinary skill in the art, and that such modifications and variations are considered to be within the scope of embodiments of the present disclosure.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section. The term "about" as used herein can allow for a degree of variability in a value or range, for example, within 10%, within 5%, or within 1% of a stated value or of a stated limit of a range, and includes the exact stated value or range. The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%.

In the methods described herein, the acts can be carried out in any order without departing from the principles of the disclosure, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

What is claimed is:

1. A method of forming an abrasive article, comprising:

depositing a layer of an abrasive mixture onto a dispensing surface from an abrasive mixture dispenser at an abrasive mixture depositing location;

moving the dispensing surface from the abrasive mixture depositing location to a leveling location;

leveling the layer of the abrasive mixture at the leveling location, which is separate from the abrasive mixture depositing location, using a leveling tool, such that the layer has a substantially smooth surface;

moving the dispensing surface from the leveling location to a liquid dispensing station;

applying a liquid material from a liquid dispenser at the liquid dispensing station, which is separate from the abrasive mixture depositing location and separate from the leveling location to the compacted layer of abrasive mixture;

moving the dispensing surface from the liquid dispensing station to a setting station;

allowing the layer of abrasive mixture and dispensed liquid to set at the setting station, which is separate from the abrasive mixture depositing location, separate from the leveling location and separate from the setting station;

repeating the steps of depositing, leveling, applying and setting to form a multilayered abrasive article.

2. The method of claim 1 further comprising compacting the layer of the abrasive mixture, using a compacting tool at a compacting location, such that a density of the layer of abrasive mixture increases.

3. The method of claim 2, wherein the abrasive mixture dispenser, the leveling tool, the compacting tool, the liquid dispenser and the setting station are parts of a first modular assembly.

4. The method of claim 1, wherein the applied liquid material is a temporary binder configured to be burnt out during later processing of the abrasive article.

5. The method of claim 1, wherein the abrasive mixture comprises a permanent binder precursor, and the permanent binder precursor is configured to be activated during later processing of the abrasive article.

6. The method of claim 1, wherein the applied liquid material is a reactive agent that reacts with a compound of the abrasive mixture.

7. The method of claim 1, wherein the liquid material is applied in a pattern on the layer of abrasive mixture such that at least a portion of the layer receives no liquid material.

8. The method of claim 7, wherein the liquid material is applied in subsequent layers in a pattern such that a channel is formed through the abrasive article.

9. The method of claim 8, wherein the channel is an arcuate, tortuous or straight channel extending at least partway through the abrasive article.

10. A system for forming an abrasive article, comprising:

a workspace;

an abrasive material dispenser that deposits a layer of abrasive material onto the workspace, while the workspace is at a dispensing position;

a leveler that levels a surface of abrasive material on the workspace, while the workspace is at a leveling position;

a binder jet printer that dispenses a liquid binder onto the layer of abrasive material, while the workspace is at a printing position;

wherein the dispensing position, the leveling position, and the printing position are in physically separate locations from one another; and wherein the workspace is on a moving surface that moves the workspace between the dispensing position under the dispenser, the leveling position under the leveler, and the printing position under the printer.

11. The system of claim 10, further comprising a setting station that at least partially dries the liquid binder.

12. The system of claim 11, wherein the abrasive material dispenser, leveler, and setting station remain substantially in place with respect to each other.

13. The system of claim 10, wherein the leveler is at an adjustable height with respect to the workspace.

14. The system of claim 10, further comprising a densification station and wherein the densification station comprises one of: a rotating compactor, a stamper, or a vibratory unit.

15. The system of claim 10, further comprising a magnetic orientation unit configured to orient particles within the layer of abrasive material.

16. An additive manufacturing system, comprising:

a printing workspace;

a series of printing assemblies;

wherein each of the printing assemblies is a modular printing assembly, wherein each of the modular printing assembly comprises a particle dispensing unit and a liquid dispensing unit;

wherein the particle dispensing unit and the liquid dispensing unit of each of the printing assemblies are at physically separate locations from one another;

wherein the printing workspace moves relative to the series of printing assemblies;

wherein each of the series of printing assemblies deposits a layer of an abrasive mixture on the printing workspace and each of the series of printing assemblies deposits liquid on the abrasive mixture, such that, after the printing workspace passes through the series of printing assemblies, an abrasive article is formed.

17. The system of claim 16, wherein the printing workspace is coupled to a movement mechanism such that the printing workspace moves under each of the printing assemblies.

18. The system of claim 16, wherein at least one of the modular printing assemblies includes a densification unit.

19. The system of claim 16, further comprising an orientation station configured to impart an orientation to particles of the abrasive mixture dispensed by the particle dispensing unit.

* * * * *